US005119069A

United States Patent [19]

Hershkovitz et al.

[11] Patent Number: 5,119,069

[45] Date of Patent: Jun. 2, 1992

[54] APPARATUS AND METHOD FOR LOCATING BOUNDARIES OF DETECTION ZONES COVERED BY A PASSIVE INFRARED DETECTION SYSTEM

[76] Inventors: Shmuel Hershkovitz; Pinhas Shpater, both of 1435 Beverly Crescent, Chomedey Laval, Quebec, Canada, H7W 3T6

[21] Appl. No.: 550,473

[22] Filed: Jul. 10, 1990

[30] Foreign Application Priority Data

Aug. 7, 1989 [CA] Canada ..... 607681

[51] Int. Cl.[5] ..... G08B 29/00

[52] U.S. Cl. ..... 340/515; 340/514; 340/555; 250/342; 358/110; 358/113; 359/110

[58] Field of Search ..... 250/342, 345, 347; 340/541, 514, 515, 518, 555, 556, 565, 436, 903; 358/108, 110, 113; 359/109, 110, 197, 196

[56] References Cited

U.S. PATENT DOCUMENTS 4,275,303 6/1981 Mudge ..... 250/342
4,317,998 3/1982 Dore .
4,451,734 5/1984 St. Jean et al. .
4,566,808 1/1986 Pompei et al. .
4,612,442 9/1986 Toshimichi ..... 250/342
4,642,454 2/1987 Carlson .

OTHER PUBLICATIONS

OPTEX, Inc., "Wireless Sensor-Annunciator System", Dec. 1988.

*Primary Examiner*—Donnie L. Corsland
*Attorney, Agent, or Firm*—Collard, Roe & Galgano

[57] ABSTRACT

An audio indicator apparatus for locating boundaries of optically divided detection zones covered by a passive infrared detection system having a collector for collecting infrared rays from the zones of an area to be monitored, and a detector for passively detecting infrared rays collected by the collector and for generating a first signal having an amplitude responsive to the rays collected by the collector, which includes a signal generator to be connected to a speaker for producing a second signal responsive to the first signal, the second signal being indicative of activity of the detection system at a point, within the area to be monitored, where an infrared radiation emitting object is moved, to locate the boundaries of the zones.

12 Claims, 1 Drawing Sheet

APPARATUS AND METHOD FOR LOCATING BOUNDARIES OF DETECTION ZONES COVERED BY A PASSIVE INFRARED DETECTION SYSTEM

FIELD OF THE INVENTION

The present invention relates to a method and apparatus for locating boundaries of optically divided detection zones covered by a passive infrared detection system. The invention relates further to a method and apparatus for determining the sensitivity of a passive infrared detection system at boundaries of optically divided detection zones.

BACKGROUND OF THE INVENTION

Passive infrared detection systems are known in the art to be used for intrusion detection for example in the field of security or lighting control. A passive infrared detection system is designed to detect the movement of an infrared radiation emitting object (e.g. a person) in an area to be monitored. The system has a detector which includes (as is known in the art) a lens to collect infrared rays, as well as a pyroelectric sensor for generating a signal responsive to the radiation collected by the lens. The lens optically divides the area into zones from which rays can be received. The movement of an infrared radiation emitting object across a zone boundary causes a change in the intensity of infrared radiation impinging on the sensor. Thus movement across a zone boundary will cause a signal to be generated which can be used to generate an alarm signal.

When installing a detector, it is important to place the zone boundaries strategically within the area to be monitored. The conventional method of locating boundaries of optically divided detection zones is to move an infrared emitting object (namely a person) within the area to be monitored and to observe an LED indicator located on the detector of a passive infrared detection system. The LED indicator is turned on when an alarm condition is detected. According to the conventional method, one must keep the LED indicator in constant view. The requirement that the LED be in constant view is a serious impediment to the person locating the zones, since the LED indicator is difficult to see and all movement within the area must be made while facing the LED.

SUMMARY OF THE INVENTION

It is therefore an object of the present invention to provide a method and apparatus for locating zone boundaries of a passive infrared intrusion detection system which facilitates the location of the zone boundaries. It is a further object of the present invention to provide a method and apparatus for determining the sensitivity of a passive infrared detection system at any point in the area to be monitored when movement by an infrared radiation emitting object is made.

According to the present invention, the activity of a passive infrared detection system is communicated to a person locating zones of an optically divided area to be monitored by means of an audio signal. The audio signal may be output by a fixed location speaker, or by a portable speaker which receives the audio signal by radio communication. Locating the zone boundaries by means of the audio signal eliminates the problems of having to face the LED indicator and having to keep constant visual surveillance of the LED indicator. The audio signal can be received and acknowledged by the person locating the zones without distracting the person's other senses and functions, such as observing where the zone boundaries are located in the area to be monitored, taking notes thereof, and possibly determining the sensitivity of a zone boundary located by varying the movement across the zone boundary.

The present invention provides an audio indicator apparatus for locating boundaries of optically divided detection zones covered by a passive infrared detection system having a collector for collecting infrared rays from the zones of an area to be monitored, and a detector for passively detecting the infrared rays collected by the collector and for generating a first signal having an amplitude responsive to the rays collected by the collector, which comprises a signal generator to be connected to a speaker for producing a second signal responsive to the first signal, the second signal being indicative of activity of the detection system at a point, within the area to be monitored, where an infrared radiation emitting object is moved, to locate the boundaries of the zones.

The invention also provides a method of locating boundaries of optically divided detection zones covered by a passive infrared detection system having a collector for collecting infrared rays from the zones of an area to be monitored, and a detector for passively detecting the infrared rays collected by the collector and for generating a first signal having an amplitude responsive to the rays collected by the collector, comprising the steps of; moving an infrared emitting object within the area to be monitored, producing a second signal in response to the first signal, the first signal being responsive to the object moved, and locating at least one of the boundaries by using the second signal.

BRIEF DESCRIPTION OF THE DRAWINGS

Other objects and features of the present invention will become more apparent by means of the following description of a preferred embodiment with reference to the drawing, wherein.

DETAILED DESCRIPTION OF THE PREFERRED EMBODIMENT

Figure 1:
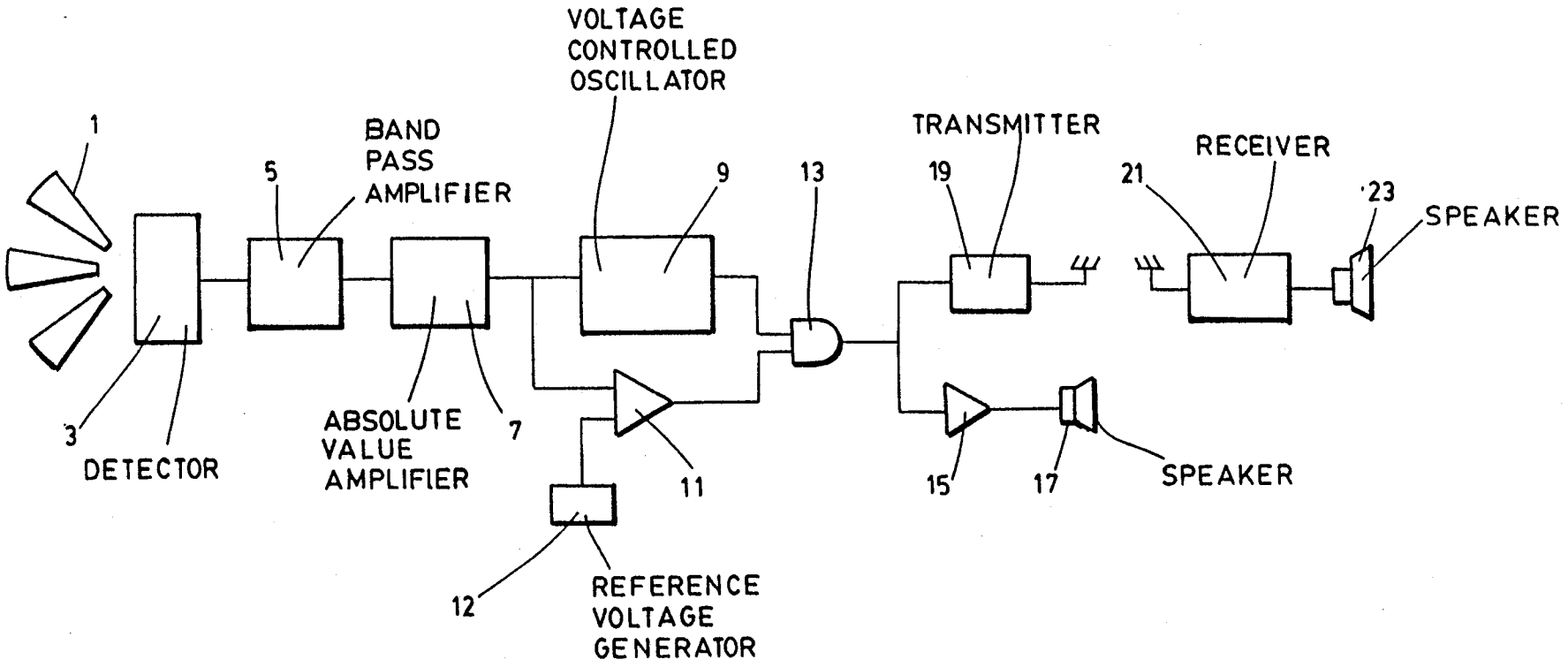
FIG. 1 a schematic block diagram of a passive infrared intrusion detection system according to the preferred embodiment.

In the preferred embodiment a passive infrared detection system has an infrared ray collector coupled to a pyroelectric sensor which together combine to form a detector 3. The detector 3 will receive infrared radiation from zones 1 and produce an electric signal in response to the intensity of the infrared rays collected. A band pass amplifier 5 which receives the output from the detector 3, has a flat frequency response and amplifies the proelectric signal with a gain of 4,000, to produce a filtered signal in the band of 0.1 Hz to 10 Hz. The output of the band pass amplifier 5 is fed to the absolute value amplifier 7 which rectifies the signal. The output of the absolute value amplifier 7 is fed to the input of voltage control oscillator 9 and comparator 11. The voltage control oscillator receives a signal in the range of 0 to 5 V and produces a signal with a frequency of 2 kHz at 5 V input. The frequency of the voltage control oscillator 9 is 0 Hz at 0 V input and proportional to the input voltage in the range between 0 and 5 V. Comparator 11 compares the signal voltage to reference voltage 12 which is set in the preferred embodiment to 0.6 V. The comparator 11 will output a signal when the signal output from the absolute value amplifier is above 0.6 V. The outputs of the voltage control oscillator 9 and the comparator 11 are fed to an AND gate 13. The AND gate 13 outputs a digital signal of 0 or 5 V at a frequency set by the voltage control oscillator 9 whenever the comparator receives a signal from the absolute value amplifier 7 above the voltage of the reference voltage 12. The square pulses from the output and the AND gate 13 constitute the audio signal which is fed as shown in FIG. 1 to two audio output circuits. The output of AND gate 13 is fed to amplifier 15 whose output is fed directly to a speaker 17. The output of AND gate 13 is also fed to transmitter 19 which transmits the audio signal to a receiver 21 which then feeds the audio signal to a speaker 23.

A person crossing a boundary of one of the zones 1 will hear an audio signal with a frequency responsive to the infrared energy collected by the detector 3. In this way an installer of an infrared detector can define exactly where a covered zone is located and also what the sensitivity of the detector at that zone boundary is. The installer may also determine if a source of strong noise (such as a heater) is located at a protected zone, or if there is any problem with the detector.

The zones 1 covered by the detector 3 are formed by the geometry of a lens of the collector and the pyroelectric sensor contained within the detector 3, and therefore a multi-element sensor (e.g. dual element sensor) can be tested for each element separately (each element of a multi-element sensor forms an independent zone).

As can be understood from the foregoing description of the preferred embodiment the apparatus according to the present invention can be used both for locating boundaries of the zones 1 as well as for determining a degree of activity of the detection system at a boundary located. Many variations of the invention are possible. The audio signal need not indicate the degree of activity of the detection system. The preferred embodiment shows the use of frequency to indicate the degree of activity of the detection system. It is also possible to use the volume of the audio signal to indicate the degree of activity of the detection system. In the preferred embodiment AND gate 13 is used to generate the audio signal when signals are received from both the comparator 11 and voltage control oscillator 9. Alternatively AND gate 13 could be replaced by a transistor switch allowing the signal from the voltage control oscillator 9 to pass when a gating signal is received from the comparator 11.

The transmitter 19 and receiver 21 preferably consist of an FM transmitter and receiver system. The FM receiver and speaker unit can conveniently be a small portable FM receiver with an earphone as commercially available.

The above description of the preferred embodiment is not intended to limit the scope of the present invention, as defined in the appended claims.

The embodiments of the invention in which an exclusive property or privilege is claimed are defined as follows:

1. An audio indicator apparatus for locating boundaries of a plurality of optically divided detection zones covered by a passive infrared detection system having collecting means for simultaneously collecting infrared rays from said zones of an area to be monitored, and detector means for detecting a change in an intensity of said infrared rays collected by said collecting means and for generating a first signal having an amplitude responsive to said change, the apparatus comprising:

generating means, to be connected to an audio output device audible in said area, for producing a second signal continuously responsive to said first signal, said second signal being variable and indicative of activity of said detection system at a point, within said area to be monitored, where an infrared radiation emitting object is moved within said area, said second signal permitting detection of said boundaries of said zones, said generating means including an audio frequency signal generator and a modulator controlled by said first signal for modulating an output of said generator.

2. An audio indicator apparatus according to claim 1, wherein said generating means generates said second signal when the amplitude of said first signal exceeds a preset value.

3. An audio indicator apparatus according to claim 1, wherein said second signal is a variable signal, which is indicative of a degree of said activity of said detection system at said point.

4. An audio indicator apparatus according to claim 3, wherein said second signal is produced when said first signal has an amplitude greater than a preset value.

5. An audio indicator apparatus according to claim 1, wherein said output device comprises an amplifier for amplifying said second signal, said output device being wired to a loud speaker.

6. An audio indicator apparatus according to claim 1, wherein said output device comprises wireless transmission means for transmitting said second signal to portable receiver means connected to a loud speaker.

7. An audio indicator apparatus according to claim 1, wherein said detector means include a bandpass amplifier to generate said first signal, in a desired frequency range of approximately 0.1 to 10 Hz.

8. An audio indicator apparatus for locating boundaries of a plurality of optically divided detection zones covered by a passive infrared detection system having collecting means for simultaneously collecting infrared rays from said zones of an area to be monitored, and detector means for detecting a change in an intensity of said infrared rays collected by said collecting means and for generating a first signal having an amplitude responsive to said change, the apparatus comprising:

generating means, to be connected to an audio output device audible in said area, for producing a second signal continuously responsive to said first signal, said second signal being variable and indicative of activity of said detection system at a point, within said area to be monitored, where an infrared radiation emitting object is moved within said area, said second signal permitting detection of said boundaries of said zones, said generating means including a voltage controlled oscillator which is fed said first signal, to produce said second signal whose frequency varies with the amplitude of said first signal.

9. A method of locating boundaries of a plurality of optically divided detection zones covered by a passive infrared detection system having collecting means for collecting infrared rays from said zones of an area to be monitored, and detector means for detecting a change in an intensity of said infrared rays collected by said collecting means and for generating a first signal having an amplitude responsive to said change, comprising the steps of:

a) moving an infrared emitting object within said area to be monitored;

b) producing a second signal continuously responsive to said amplitude of said first signal, said first signal being responsive to said object moved in step a);

c) generating an audio frequency signal;

d) modulating said audio frequency signal using said second signal to produce a modulated audio signal audible in said area responsive to said second signal; and e) said second signal permitting detection of at least one of said boundaries by using said modulated audio signal produced in step d).

10. A method according to claim 9, wherein said second signal produced in said step (b) is variable and indicative of a level of the amplitude of said first signal, further comprising a step (e) of determining sensitivity of said detector system at said at least one boundary located in step (d) by using said audio signal.

11. A method according to claim 10, wherein said step (b) comprises steps of comparing said first signal, with a preset value, and generating said second signal when said amplitude of said first signal exceeds said preset value.

12. A method according to claim 9, wherein said step (b) comprises steps of comparing said first signal, with a preset value, and generating said second signal when said amplitude of said first signal exceeds said preset value.

* * * * *